US008091565B2

(12) United States Patent
Ramos

(10) Patent No.: US 8,091,565 B2
(45) Date of Patent: Jan. 10, 2012

(54) MAKEUP CASE WITH DRAWER

(75) Inventor: Victor Ramos, Rambouillet (FR)

(73) Assignee: Alcan Packaging Beauty Services, Gennevilliers (FR)

( * ) Notice: Subject to any disclaimer, the term of this patent is extended or adjusted under 35 U.S.C. 154(b) by 254 days.

(21) Appl. No.: 12/473,224

(22) Filed: May 27, 2009

(65) Prior Publication Data

US 2009/0293902 A1 Dec. 3, 2009

(30) Foreign Application Priority Data

May 29, 2008 (FR) ..... 08 53507

(51) Int. Cl.
*A45D 33/20* (2006.01)

(52) U.S. Cl. ..... 132/287; 132/286

(58) Field of Classification Search ..... 132/287, 132/288, 293, 294, 295, 300, 314; 312/330.1, 312/334.1, 348.2; 206/581, 823, 387.12, 206/387.15, 817; 220/345.1, 345.4, 348, 220/521, 524, 811, 812
See application file for complete search history.

(56) References Cited

U.S. PATENT DOCUMENTS

| | | | | |
|---|---|---|---|---|
| 2,220,351 | A | 11/1940 | Reese et al. | |
| 3,969,007 | A * | 7/1976 | Lowry | 312/9.21 |
| RE32,753 | E * | 9/1988 | Ackeret | 206/387.12 |
| 5,139,146 | A * | 8/1992 | Weber et al. | 206/387.15 |
| 5,279,413 | A * | 1/1994 | Nehl et al. | 206/0.82 |
| 5,303,993 | A * | 4/1994 | Stephan et al. | 312/9.22 |
| 6,378,702 | B1 * | 4/2002 | Kintzig | 206/456 |
| 7,140,372 | B2 * | 11/2006 | Byun | 132/287 |
| 7,905,238 | B2 * | 3/2011 | Moon | 132/287 |
| 2004/0119297 | A1 | 6/2004 | Bella et al. | |
| 2004/0200497 | A1 * | 10/2004 | Thorpe et al. | 132/287 |
| 2006/0219256 | A1 * | 10/2006 | Byun | 132/287 |
| 2007/0017848 | A1 * | 1/2007 | Sasaki | 206/581 |
| 2009/0288677 | A1 * | 11/2009 | Chen | 132/315 |
| 2010/0295222 | A1 * | 11/2010 | Lee et al. | 267/155 |

FOREIGN PATENT DOCUMENTS

EP 1 466 539 A1 10/2004

* cited by examiner

*Primary Examiner* — Todd Manahan
*Assistant Examiner* — Tatiana Nobrega
(74) *Attorney, Agent, or Firm* — Blakely, Sokoloff, Taylor & Zafman

(57) ABSTRACT

The invention concerns a makeup case. A primary tray as well as a tray form a drawer slidingly mounted in relation to the primary tray. A spring exerts a force tending to assist the opening of the tray forming the drawer or a force tending to assist its closing depending on whether or not the tray forming the drawer is open beyond an intermediate position which corresponds to an unstable position for the spring. The spring may be two torsion springs arranged symmetrically on either side of an axis extending along the direction of the opening or closing movement of the tray forming the drawer.

9 Claims, 5 Drawing Sheets

MAKEUP CASE WITH DRAWER

BACKGROUND OF THE INVENTION

The present invention concerns makeup cases.

More particularly, it proposes a makeup case with a drawer.

A makeup case traditionally comprises a cup intended to receive one or several makeup products, such as a blusher or eye shadow type powder, and a cover, which can be of the shutter type, articulated on this cup.

Makeup case structures have already been proposed which also integrate a sliding drawer which receives another cosmetic product or which allows the storage of makeup accessories: brush, powder puff, etc.

Examples of this type are described in particular in patent applications EP 1,500,347 or US 2004/0221866, which each provide that spring means (spring blades, helical spring) assist the opening movement of the drawer to cause it to come out nearly automatically in relation to the rest of the case when the user releases the drawer.

In these examples, the closing of the drawer requires an effort by the user, who must manually push the drawer back in, until elastic locking in the closed position of the drawer on the case occurs. This elastic locking is often relatively complex to achieve, if one wishes to avoid the user having a feeling of forced passage.

Furthermore, due to the sliding play of the drawer in relation to the case, structures of this type are not fully satisfactory as to the quality perceived by the user when he opens or closes the drawer.

SUMMARY OF THE INVENTION

One aim of the invention is to provide a makeup case with a drawer which does not have the drawbacks of those of the prior art.

Indeed, we wish to be able to provide makeup cases with drawers in which both the opening and the closing of the drawer are facilitated and do not require effort or forced passage by the user.

We also wish to be able to provide makeup case structures with drawers which have a structure such that they give customers a great sensation of quality.

Still another aim of the invention is to provide a makeup case with a drawer which has a particularly simple assembly.

The invention in particular provides a makeup case comprising a primary tray, as well as a tray forming a drawer slidingly mounted in relation to the primary tray, and spring means which are inserted between the primary tray and the tray forming the drawer and which are able to exert a force tending to assist the opening of the tray forming the drawer in relation to the primary tray, characterized in that said spring means are also able to exert a force tending to assist the closing of the tray forming the drawer in relation to the primary tray, said spring means exerting a force tending to assist the opening of the tray forming the drawer or a force tending to assist its closing depending on whether or not the tray forming the drawer is open beyond an intermediate position which corresponds to an unstable position for said spring means.

The primary tray is, for example, able to receive at least one makeup product and comprises a cover articulated on the primary tray. However, further alternative embodiments can be considered. For example, the primary tray without a cup or cover and makeup product(s) housed only in the tray forming the drawer.

The spring means can include at least one torsion spring and in particular two torsion springs arranged symmetrically on either side of an axis extending along the direction of the opening or closing movement of the tray forming the drawer.

A case of this type is also advantageously completed by the following various characteristics, taken alone or in combination:

It comprises a part forming a slide channel which is able to slide in relation to the primary tray or in relation to the tray forming the drawer and on which a torsion spring is secured by one of its ends.

The end of the torsion spring is secured on an intermediate part which in turn is fixed by elastic locking on an edge of the slide channel part.

The other end of said spring is secured to the bottom of the primary tray.

The slide channel part is secured on the tray forming the drawer and comprises means which cooperate with additional means of the primary tray in order to guide the sliding of said slide channel part and of said tray forming the drawer in relation to the primary tray.

In the direction corresponding to the opening or closing movement of the tray forming the drawer, the slide channel part has dimensions smaller than the opening travel of said tray.

It also comprises a protective cover able to conceal the slide channel part.

One torsion spring is a flat helical spring.

BRIEF DESCRIPTION OF THE DRAWINGS

Other characteristics and advantages of the invention will also emerge from the description which follows, which is purely illustrative and non-limiting, and should be read with regard to the appended Figures in which.

DETAILED DESCRIPTION OF THE EMBODIMENTS

Figure 1:
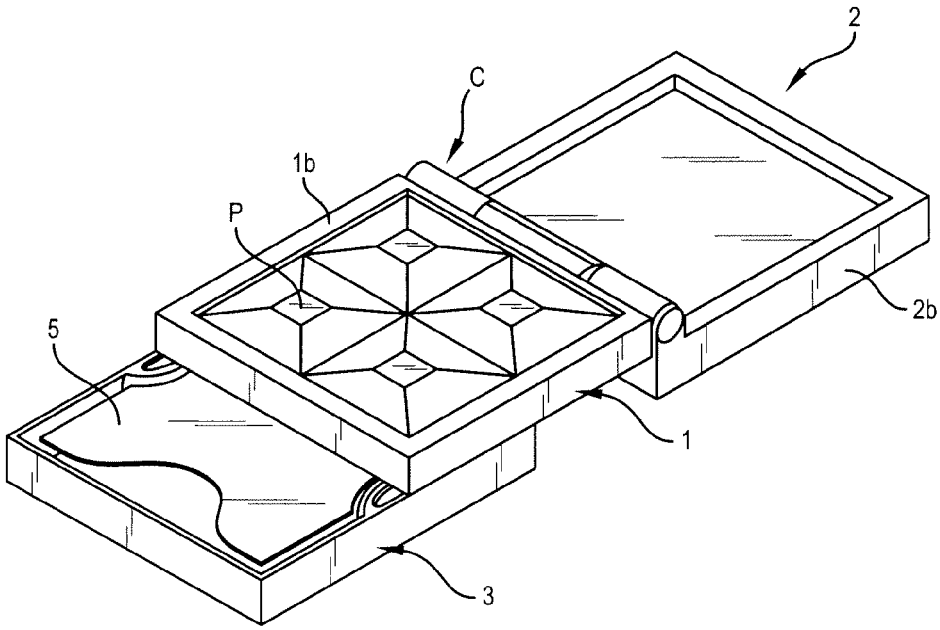
FIG. 1 is a diagrammatic perspective illustration of a makeup case according to one possible embodiment of the invention.
Figure 2:
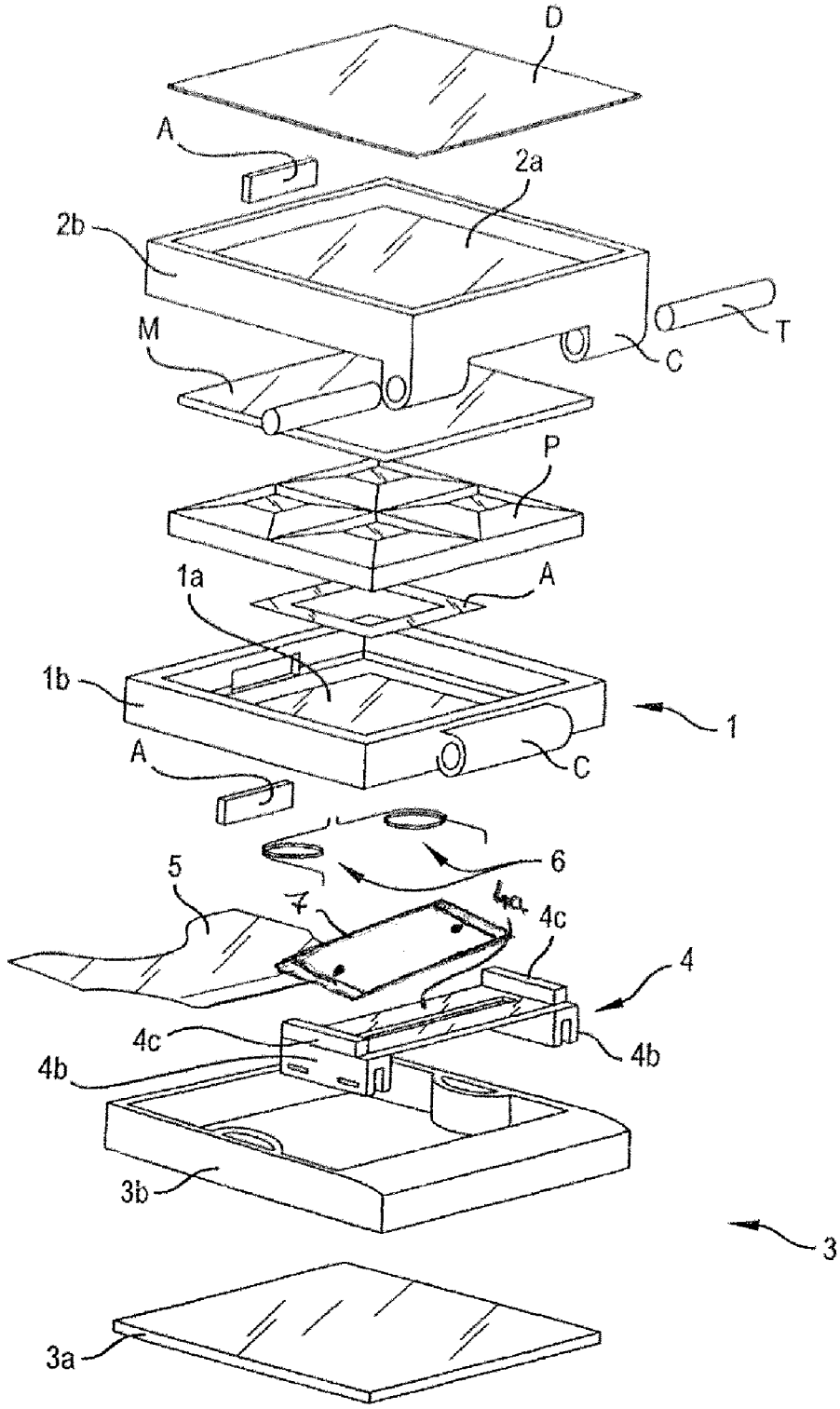
FIG. 2 is an exploded perspective view of the case of FIG. 1.

The case presented in FIGS. 1 and 2 comprises, on the one hand, a primary tray 1, which constitutes the cup receiving makeup powders P (e.g. blusher or eye shadow), and on the other hand a closing cover 2 articulated on said tray 1.

A lower tray 3 is slidingly mounted on the primary tray 1 and constitutes a drawer intended to receive either another cosmetic product or a makeup accessory, for example.

The primary tray 1 is in this case present in the form of a generally square-shaped compartment defined by a bottom 1*a* and a rim 1*b* which surrounds the latter part over its entire periphery.

The cover 2 is also present in the form of a square-shaped element, having a bottom 2*a* (with one or several external decoration layers D) and a rim 2*b* which surrounds said bottom 2*a*. A mirror M can be arranged inside said cover 2.

The primary tray 1 and the cover 2 are articulated, one on the other, on one side of the rim 1*a* and the rim 2*a*, by means C forming a hinge, the cylindrical parts of which are molded integral with the tray 1 and the cover 2, these cylindrical parts being articulated together by a rod T. Magnets A inserted in the rims 1*b* and 2*b*, as well as on the bottom of the tray 1 forming the cup, ensure that the cover 2 is kept in the closed position on the tray 1 forming the cup.

The tray 3, also generally square-shaped, likewise comprises a bottom 3*a* surrounded by a rim 3*b*. Its sliding in relation to the tray 1 is ensured by slide channel part 4 forming a slide channel which is secured on said tray 3, inside the latter part, near the side of the rim 3*b* which is intended to be found level with the hinge C or in proximity thereto.

Figure 3A:
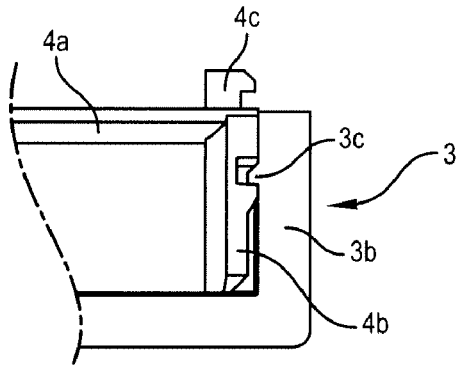
FIGS. 3*a* and 3*b* are detail views, in cross-section and perspective view, respectively, illustrating one possible example for securing the slide channel part on the tray forming the drawer.
Figure 3B:
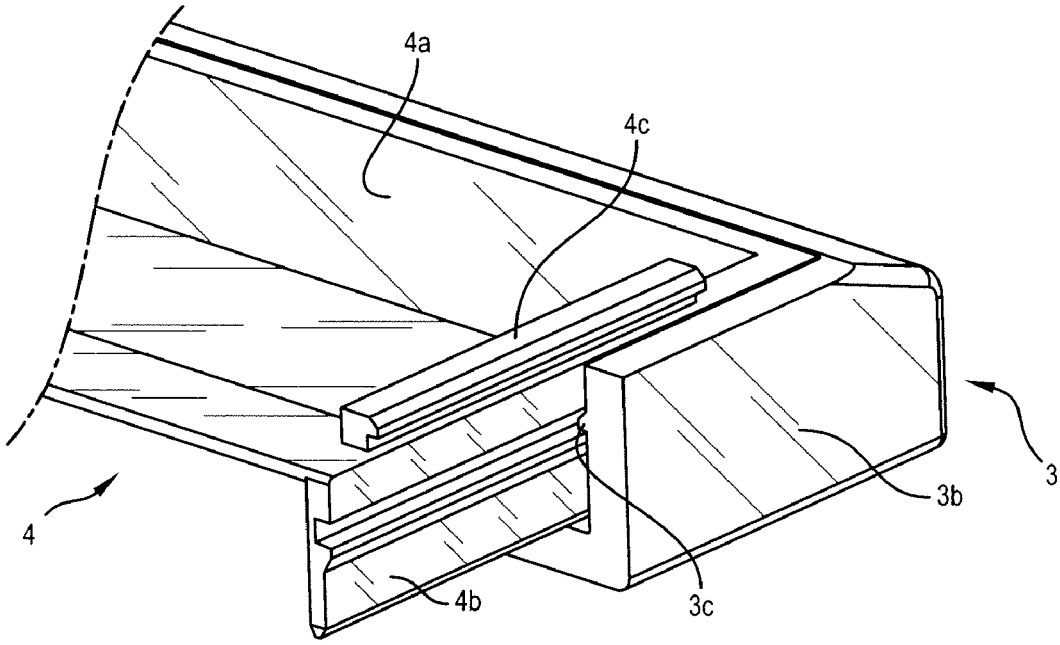

This part 4 has a U-shaped section. It has in particular a bottom 4*a* which extends between the two lateral sides of the rim 1*b* and which is intended to be pressed against the bottom 1*a* in order to slide along the latter part when the drawer-tray slides. This part 4 also has, as illustrated more particularly by FIGS. 3*a*-3*b*, two lateral tags 4*b* configured to lock elastically on internal protrusions 3*c* presented by the rim 3*b* at its lateral sides. The lateral tags 4*b* thus ensure securing of the part 4 on the tray 3.

Figure 4A:
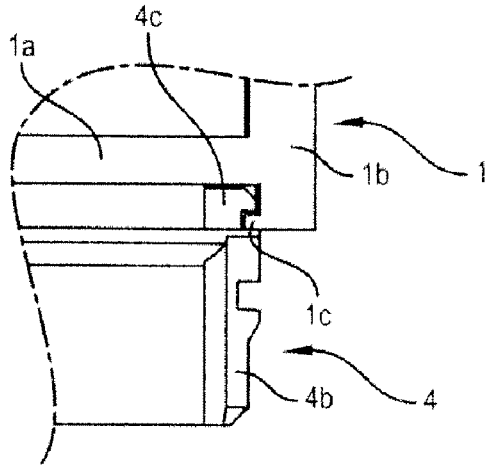
FIGS. 4*a* and 4*b* are detail views, in cross-section and in perspective view, respectively, illustrating one possible example for the means ensuring the sliding of the tray forming the drawer in relation to the primary tray.
Figure 4B:
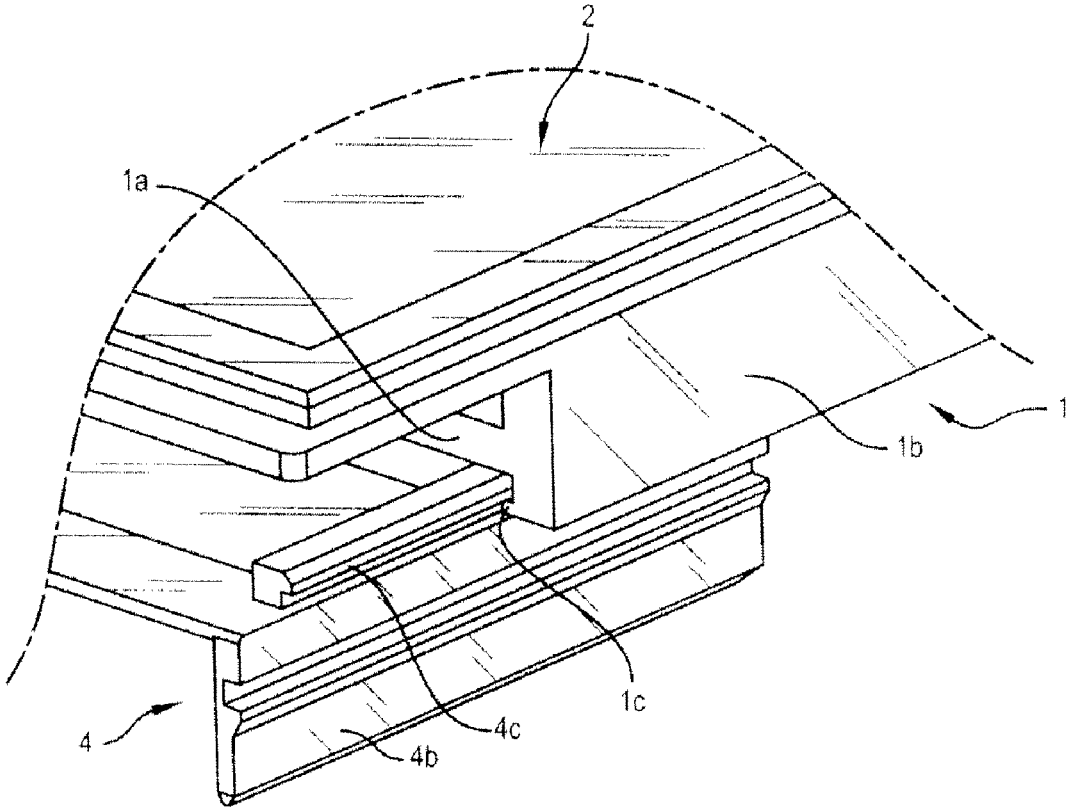

This part 4 also has, in the extension of its tags 4*b* and in lateral projection above its bottom 4*a*, guide rails 4*c* protruding outwards from the rest of the part. As shown in FIGS. 4*a*-4*b*, the rails 4*c* are intended to engage in complementary grooves laterally extending the rim 1*b* on two of its sides, under the bottom 1*a*. The rails 4*c* of the part 4 and the complementary grooves 1*c* of the part 1 ensure the sliding of the tray 3 forming the drawer (to which the part 4 forming the slide channel is secured) on the tray 1.

In the direction corresponding to the opening movement of the tray 3, this slide channel part 4 arranged at the bottom of the tray 3 has dimensions smaller than the opening travel of said tray, such that it is not directly visible by the user, even when the user opens the drawer constituted by said tray 3. A protective cover 5 can also be provided in order to completely conceal said part 4 and protect the cosmetic material or the makeup accessory arranged inside the tray 3.

The structure also includes two torsion springs 6 which make it possible to assist the opening or closing movement of the drawer tray 3.

Figure 5A:
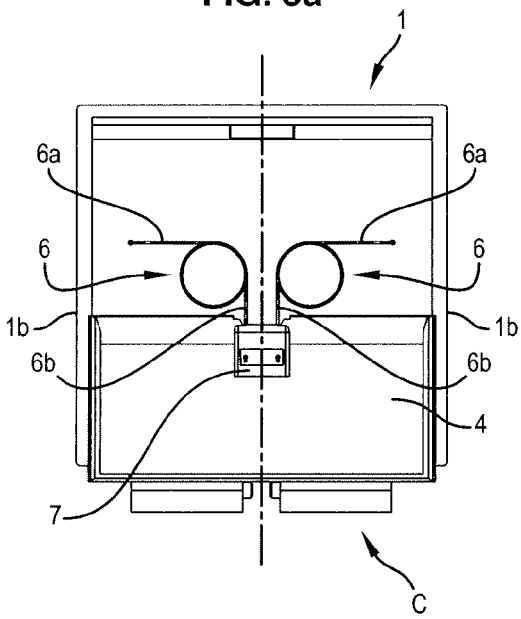
FIGS. 5*a* and 5*b* are two diagrammatic cross-sectional illustrations showing the spring means of the case of FIGS. 1 and 2 and the operation thereof.
Figure 5B:
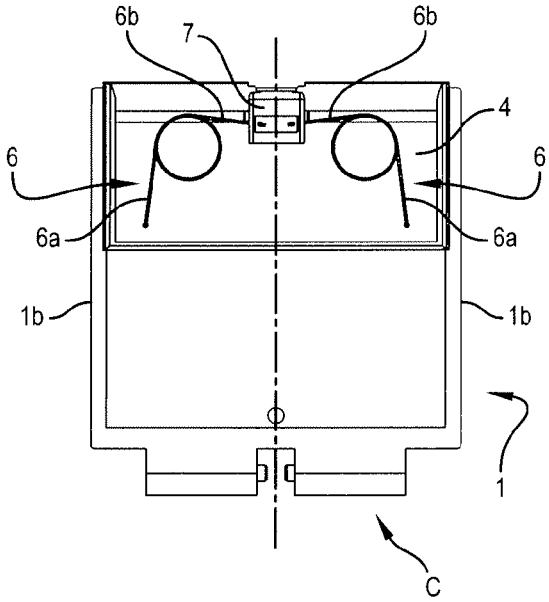
Figure 6:
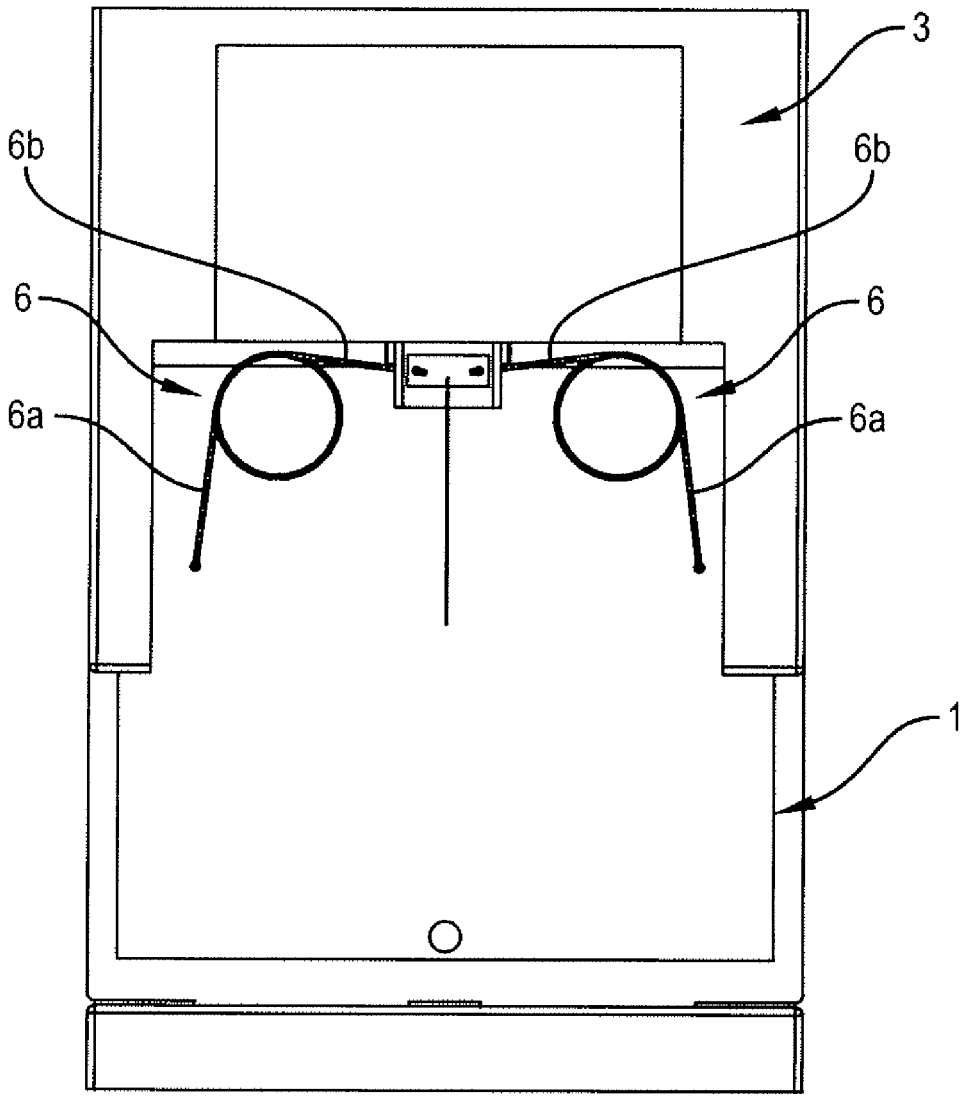
FIG. 6 is a view similar to that of FIG. 5*b*, completed by an illustration of the tray forming the drawer in the open position.

More specifically and as illustrated in FIGS. 5*a*-5*b*, as well as in FIG. 6, these two springs 6 are two flat helical springs arranged symmetrically on either side of a central axis of the case as shown in said Figures by the broken lines along the direction of the opening or closing movement of the tray 3 forming the drawer. Each of these two springs 6 ends with two branches, one 6*a* of which is secured in a hole arranged to this end on the bottom 1*a* of the tray 1, near a lateral side of the rim 1*b*, the other being secured to an intermediate part 7 which is fixed by elastic locking on a frontal edge of the part 4 forming the slide channel.

These two springs 6 accumulate a torsion stress which makes it possible to assist the sliding of the part 4 in relation to the primary tray 1; thus to cause the drawer-tray 3 to tilt between a position where it is kept closed and an open position.

Thus, when the user begins to open the drawer, the movement thus engaged turns over the two springs 6, which start from the position as illustrated in FIG. 5*a*, quickly arrive at a position which corresponds to an unstable position for both springs and from which they exert a force tending to push the slide channel part 4 and the drawer tray 3 toward the position illustrated in FIG. 5*b* and FIG. 6, in which the drawer tray 3 is totally open.

In the opposite direction, when the user begins to exert a closing force on the drawer-tray 3, the movement turns over the two springs 6 in the other direction and causes them to tilt in order to make them assume the intermediate position. From this position, the springs 6 exert a force tending to push the part 4, and therefore the drawer-tray 3, back toward its closing position. The springs 6 then go from the position illustrated in FIG. 5*b* to that illustrated in FIG. 5*a*.

In this way, the opening and the closing of the drawer tray 3 are done nearly automatically, the user having only to begin the movement corresponding to this opening or closing, the end of the movement taking place by itself under the effect of the torsion stress of the two springs 6.

One will also note that in such a structure, the two torsion springs 6 ensuring the opening and closing of the drawer tray 3 contribute to limiting the sliding play of the drawer tray 3 in relation to the rest of the case. In particular, the springs, when they are in either the open or closed drawer position, are slightly stressed (this value can be adjusted according to the assembly positions), and naturally ensure stable maintenance of this drawer in the open or closed position without using mechanical clipping. The result is that the user perceives the case to be of better quality.

As one will also have understood, such a structure is particularly easy to assemble. The branches 6*a* and 6*b* of the springs are first clamped on the bottom 1*b* and the intermediate part 7, which is then placed on the part 4 forming the slide channel. After these first operations, the slide channel part 4 is secured, for example by force, on the drawer tray 3, while the slugs or rails on its sides are engaged in the grooves of the tray 1. The assembly of the tray and the cover 2 is done traditionally.

The invention claimed is:

1. A makeup case comprising a primary tray (1) as well as a tray forming a drawer (3) slidingly mounted in relation to the primary tray (1), and spring means which are inserted between the primary tray and the tray forming the drawer (3) and which are able to exert a force tending to assist the opening of the tray forming the drawer (3) in relation to the primary tray (1), characterized in that said spring means (6) are also able to exert a force tending to assist the closing the tray forming the drawer (3) in relation to the primary tray (1), said spring means (6) exerting a force tending to assist the opening of the tray forming the drawer (3) or a force tending to assist its closing depending on whether or not the tray forming the drawer (3) is open beyond an intermediate position which corresponds to an unstable position for said spring means (6), wherein said spring means (6) comprise two torsion springs arranged symmetrically on either side of an axis extending along the direction of the opening or closing movement of the tray forming the drawer (3).

2. The makeup case according to claim 1, characterized in that the primary tray (1) is able to receive at least one makeup product and comprises a cover (2) articulated on the primary tray (1).

3. The makeup case according to claim 1, characterized in that it comprises a part forming a slide channel (4) which is able to slide in relation to the primary tray (1) or in relation to the tray forming the drawer (3) and on which a torsion spring (6) is secured by one of its ends (6*b*).

4. The makeup case according to claim 3, characterized in that said end of the torsion spring is secured on an intermediate part (7) which in turn is fixed by elastic locking on an edge of the slide channel part (4).

5. The makeup case according to claim 3, characterized in that the other end of said spring is secured to the bottom (1*a*) of the primary tray (1).

6. The makeup case according to claim 3, characterized in that the slide channel part (4) is secured to the tray forming the drawer (3) and comprises means which cooperate with complementary means of the primary tray (1) in order to guide the sliding of said slide channel part (4) and of said tray forming the drawer (3) in relation to the primary tray (1).

7. The makeup case according to claim 3, characterized in that in the direction corresponding to the opening or closing movement of the tray forming the drawer (3), the slide channel part (4) has dimensions smaller than the opening travel of said tray.

8. The makeup case according to claim 3, characterized in that it also comprises a protective cover (5) able to conceal the slide channel part (4).

9. The makeup case according to claim 1, characterized in that one torsion spring (6) is a flat helical spring.

* * * * *